US012612843B2

(12) United States Patent
Chevallier et al.

(10) Patent No.: US 12,612,843 B2
(45) Date of Patent: Apr. 28, 2026

(54) MECHANICAL SUPPORT FOR EXPANDABLE LINER HANGER

(71) Applicant: Halliburton Energy Services, Inc., Houston, TX (US)

(72) Inventors: Francois Chevallier, Singapore (SG); Daniel Newton, Singapore (SG); Yian Zhao, Singapore (SG); Xiaoguang Allan Zhong, Singapore (SG); Michael Linley Fripp, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/396,082

(22) Filed: Dec. 26, 2023

(65) Prior Publication Data

US 2025/0207483 A1 Jun. 26, 2025

(51) Int. Cl.
*E21B 43/10* (2006.01)

(52) U.S. Cl.
CPC ..... *E21B 43/105* (2013.01)

(58) Field of Classification Search
CPC ..... E21B 43/105
See application file for complete search history.

(56) References Cited

U.S. PATENT DOCUMENTS 1,982,569 A 11/1934 Byrd
3,018,830 A * 1/1962 Springer ..... E21B 43/10 166/216
3,046,601 A 7/1962 Hubbert et al.
3,175,618 A 3/1965 Lang et al.
3,385,367 A 5/1968 Kollsman
3,993,577 A 11/1976 Black et al.
4,445,694 A 5/1984 Flaherty
4,612,985 A 9/1986 Rubbo et al.
4,846,278 A 7/1989 Robbins
5,070,942 A 12/1991 McInnes
5,139,235 A 8/1992 Kilmer
5,163,321 A 11/1992 Perales
(Continued)

FOREIGN PATENT DOCUMENTS

CA 2751473 C 9/2014
CA 3085547 C 8/2019
(Continued)

OTHER PUBLICATIONS

Ellison, et al. "Comparative evaluation of microwave and conventional gasification of different coal types: Experimental reaction studies", Fuel, 321 (2022), 124055, 10 pgs.
(Continued)

*Primary Examiner* — D. Andrews
(74) *Attorney, Agent, or Firm* — The Hilton Firm PLLC

(57) ABSTRACT

Expansion cones and methods of using expansion cones with expandable liner hangers. An example expansion cone includes a detachable support coupled to a mandrel. The detachable support is configured to contact an interior surface of the expandable liner hanger during expansion of the liner hanger. The detachable support is further configured to detach after the liner hanger is expanded thereby producing a detached support. The detached support remains in contact with the interior surface of the expandable liner hanger after expansion of the expandable liner hanger and removal of the mandrel.

20 Claims, 8 Drawing Sheets

(56) References Cited

U.S. PATENT DOCUMENTS 5,425,419 A * 6/1995 Sieber ..... E21B 7/061 166/117.6
5,803,177 A 9/1998 Hriscu et al.
6,050,336 A 4/2000 Willauer et al.
6,098,717 A 8/2000 Bailey et al.
6,321,861 B1 11/2001 Leichter
6,367,845 B1 4/2002 Otten et al.
6,581,682 B1 6/2003 Parent et al.
6,640,893 B1 11/2003 Rummel et al.
6,695,061 B2 2/2004 Fripp et al.
6,719,063 B2 4/2004 Adams et al.
7,007,760 B2 * 3/2006 Lohbeck ..... E21B 43/105 166/207
7,007,910 B1 3/2006 Krinner et al.
7,040,404 B2 5/2006 Brothers et al.
7,387,158 B2 6/2008 Murray et al.
7,431,082 B2 10/2008 Holt et al.
7,543,639 B2 6/2009 Emerson
7,562,704 B2 7/2009 Wood et al.
7,578,347 B2 8/2009 Bosma et al.
7,591,319 B2 9/2009 Xu
7,726,395 B2 * 6/2010 McHardy ..... E21B 23/02 166/207
7,909,110 B2 3/2011 Sharma et al.
7,931,079 B2 4/2011 Nicholson
7,984,762 B2 7/2011 Renshaw et al.
8,083,000 B2 12/2011 Nutley et al.
8,086,000 B2 12/2011 Weijers et al.
8,235,075 B2 8/2012 Saltel
8,240,377 B2 8/2012 Kulakofsky et al.
8,434,571 B2 5/2013 Kannan et al.
8,443,881 B2 5/2013 Thomson et al.
8,490,707 B2 7/2013 Robisson et al.
8,499,843 B2 8/2013 Patel et al.
8,776,899 B2 7/2014 Fripp et al.
9,033,046 B2 5/2015 Andrew et al.
9,091,133 B2 7/2015 Stewart et al.
9,133,683 B2 9/2015 Dyer et al.
9,404,030 B2 8/2016 Mazyar et al.
9,518,453 B2 12/2016 Dilber et al.
9,580,981 B2 * 2/2017 Zhong ..... E21B 43/103
9,605,508 B2 3/2017 Xu et al.
9,624,752 B2 4/2017 Resink
9,702,029 B2 7/2017 Fripp et al.
9,725,979 B2 8/2017 Mazyar et al.
9,745,451 B2 8/2017 Zhao et al.
9,856,710 B2 1/2018 Zhu et al.
9,869,152 B2 1/2018 Gamstedt et al.
9,976,380 B2 5/2018 Davis et al.
10,119,011 B2 11/2018 Zhao et al.
10,337,298 B2 7/2019 Braddick
10,364,636 B2 7/2019 Davis et al.
10,428,624 B2 10/2019 Vasques
10,704,362 B2 7/2020 Themig et al.
10,851,615 B2 12/2020 Watson et al.
10,961,804 B1 3/2021 Fripp et al.
11,454,096 B2 9/2022 Bogardus et al.
2002/0125008 A1 9/2002 Wetzel et al.
2003/0150614 A1 8/2003 Brown et al.
2003/0159829 A1 8/2003 Fripp et al.
2004/0090068 A1 * 5/2004 Evans ..... E21B 17/042 285/333
2004/0118572 A1 6/2004 Whanger et al.
2004/0149418 A1 8/2004 Bosma et al.
2004/0173361 A1 9/2004 Lohbeck
2004/0244994 A1 12/2004 Jackson et al.
2005/0039927 A1 2/2005 Wetzel et al.
2005/0092485 A1 5/2005 Brezinski et al.
2005/0171248 A1 8/2005 Li et al.
2005/0199401 A1 9/2005 Patel et al.
2005/0257961 A1 11/2005 Snell et al.
2006/0039927 A1 2/2006 Aoki et al.
2006/0175065 A1 8/2006 Ross
2007/0089911 A1 4/2007 Moyes
2007/0095532 A1 5/2007 Head et al.
2007/0125532 A1 6/2007 Murray et al.
2007/0200299 A1 8/2007 Kunz
2007/0221374 A1 9/2007 Filippov et al.
2007/0257405 A1 11/2007 Freyer
2008/0066931 A1 3/2008 Xu
2008/0099209 A1 5/2008 Loretz et al.
2008/0142214 A1 6/2008 Keller
2008/0149351 A1 6/2008 Marya et al.
2008/0185150 A1 8/2008 Brown
2008/0185158 A1 8/2008 Chalker et al.
2008/0194717 A1 8/2008 Vaidya et al.
2008/0220991 A1 9/2008 Slay et al.
2008/0251250 A1 10/2008 Brezinski et al.
2009/0020286 A1 1/2009 Johnson
2009/0120640 A1 5/2009 Kulakofsky et al.
2009/0130938 A1 5/2009 Xu et al.
2009/0173505 A1 7/2009 Patel et al.
2009/0179383 A1 7/2009 Koloy et al.
2009/0188569 A1 7/2009 Saltel
2009/0242189 A1 10/2009 Vaidya et al.
2009/0242214 A1 10/2009 Foster et al.
2009/0272546 A1 11/2009 Nutley et al.
2009/0277651 A1 11/2009 Kilgore
2009/0277652 A1 11/2009 Nutley et al.
2010/0038074 A1 2/2010 Patel
2010/0139930 A1 6/2010 Patel et al.
2010/0147535 A1 6/2010 Gorrara et al.
2010/0163252 A1 7/2010 Regnault De La Mothe et al.
2010/0212891 A1 8/2010 Stewart et al.
2010/0243276 A1 9/2010 King et al.
2010/0270031 A1 10/2010 Patel
2010/0307770 A1 12/2010 Sponchia et al.
2011/0042081 A1 2/2011 Streich et al.
2011/0073310 A1 3/2011 Clemens et al.
2011/0098202 A1 4/2011 James et al.
2011/0174504 A1 7/2011 Wright et al.
2011/0226374 A1 9/2011 Kalman et al.
2011/0252879 A1 10/2011 Madhavan et al.
2011/0253393 A1 10/2011 Vaidya et al.
2012/0006530 A1 1/2012 Crabb et al.
2012/0055667 A1 3/2012 Ingram et al.
2012/0073834 A1 3/2012 Lembcke
2012/0125630 A1 5/2012 Sevre
2012/0132427 A1 5/2012 Renshaw et al.
2012/0175134 A1 7/2012 Robisson et al.
2012/0205091 A1 8/2012 Turley et al.
2012/0205092 A1 8/2012 Givens et al.
2012/0272546 A1 11/2012 Tsai
2012/0292013 A1 11/2012 Munshi et al.
2012/0292023 A1 11/2012 Hinkie et al.
2012/0318513 A1 12/2012 Mazyar et al.
2013/0056196 A1 3/2013 Hench
2013/0056207 A1 3/2013 Wood et al.
2013/0056209 A1 3/2013 Mazyar et al.
2013/0056227 A1 3/2013 Sponchia
2013/0056228 A1 3/2013 Gruetzmann et al.
2013/0112410 A1 * 5/2013 Szarka ..... E21B 33/165 166/135
2013/0146312 A1 6/2013 Gerrard et al.
2013/0213032 A1 8/2013 Xu et al.
2013/0248179 A1 9/2013 Yeh et al.
2014/0051612 A1 2/2014 Mazyar et al.
2014/0054047 A1 2/2014 Zhou
2014/0060815 A1 3/2014 Wang et al.
2014/0102728 A1 4/2014 Gamstedt et al.
2014/0231086 A1 8/2014 Jamison et al.
2014/0238692 A1 8/2014 Watson
2014/0251641 A1 9/2014 Marya et al.
2014/0262351 A1 9/2014 Derby
2014/0311741 A1 10/2014 Tunget
2014/0318780 A1 10/2014 Howard
2014/0354443 A1 12/2014 Roberson et al.
2014/0361497 A1 12/2014 Porta
2015/0021044 A1 1/2015 Davis et al.
2015/0060064 A1 3/2015 Lafferty et al.
2015/0101813 A1 4/2015 Zhao et al.
2015/0199401 A1 7/2015 Polehn et al.
2015/0233215 A1 8/2015 Yeh et al.
2015/0267501 A1 9/2015 Al-Gouhi

(56) References Cited

U.S. PATENT DOCUMENTS

| | | | |
|---|---|---|---|
| 2015/0275644 | A1 | 10/2015 | Chen et al. |
| 2015/0308214 | A1 | 10/2015 | Bilansky et al. |
| 2015/0344772 | A1 | 12/2015 | Droger et al. |
| 2015/0369027 | A1 | 12/2015 | Jones et al. |
| 2016/0032696 | A1 | 2/2016 | Caccialupi et al. |
| 2016/0047177 | A1 | 2/2016 | Martin et al. |
| 2016/0097252 | A1 | 4/2016 | Resink |
| 2016/0137912 | A1 | 5/2016 | Sherman et al. |
| 2016/0138359 | A1 | 5/2016 | Zhao et al. |
| 2016/0145965 | A1 | 5/2016 | Zhao et al. |
| 2016/0194933 | A1 | 7/2016 | O'Brien et al. |
| 2016/0201425 | A1 | 7/2016 | Walton et al. |
| 2016/0215604 | A1 | 7/2016 | Potapenko et al. |
| 2016/0230495 | A1 | 8/2016 | Mazyar et al. |
| 2016/0273299 | A1 | 9/2016 | Fripp et al. |
| 2016/0312586 | A1 | 10/2016 | De Clute-Melancon |
| 2016/0319633 | A1 | 11/2016 | Cooper et al. |
| 2016/0326829 | A1 | 11/2016 | Dolog et al. |
| 2016/0326830 | A1 | 11/2016 | Hallundbaek et al. |
| 2016/0376869 | A1 | 12/2016 | Rochen et al. |
| 2016/0376870 | A1 | 12/2016 | Roselier et al. |
| 2017/0122062 | A1 | 5/2017 | Freyer |
| 2017/0191343 | A1 | 7/2017 | Solhaug |
| 2017/0234103 | A1 | 8/2017 | Frazier |
| 2017/0261137 | A1 | 9/2017 | Williams et al. |
| 2017/0335673 | A1 | 11/2017 | Burke et al. |
| 2018/0078998 | A1 | 3/2018 | Sherman |
| 2018/0085154 | A1 | 3/2018 | Kulper et al. |
| 2018/0087346 | A1 | 3/2018 | Rochen |
| 2018/0087350 | A1 | 3/2018 | Sherman |
| 2018/0094492 | A1 | 4/2018 | Knapp et al. |
| 2018/0202271 | A1 | 7/2018 | Semple et al. |
| 2018/0216431 | A1 | 8/2018 | Walton, III et al. |
| 2018/0230772 | A1 | 8/2018 | Brandsdal et al. |
| 2018/0245420 | A1 | 8/2018 | Ringgenberg |
| 2018/0266215 | A1 | 9/2018 | Fagley, IV et al. |
| 2018/0320472 | A1 | 11/2018 | Fripp et al. |
| 2018/0355691 | A1 | 12/2018 | Andersen |
| 2018/0355693 | A1 | 12/2018 | Al-AbdulJabbar et al. |
| 2018/0362415 | A1 | 12/2018 | Doud et al. |
| 2019/0017285 | A1 | 1/2019 | Kain |
| 2019/0040721 | A1 | 2/2019 | Kohn et al. |
| 2019/0048673 | A1 | 2/2019 | Knight et al. |
| 2019/0048680 | A1 | 2/2019 | Stein et al. |
| 2019/0055808 | A1 | 2/2019 | Krueger |
| 2019/0055839 | A1 | 2/2019 | Skillingstad et al. |
| 2019/0128074 | A1 | 5/2019 | Stokes et al. |
| 2019/0153852 | A1 | 5/2019 | Lallemand et al. |
| 2019/0203101 | A1 | 7/2019 | Dusterhoft et al. |
| 2019/0249509 | A1 | 8/2019 | Jakkula et al. |
| 2019/0264543 | A1 | 8/2019 | Sherman |
| 2019/0316025 | A1 | 10/2019 | Sherman et al. |
| 2019/0360297 | A1 | 11/2019 | Heiman et al. |
| 2020/0240235 | A1 | 7/2020 | Fripp et al. |
| 2020/0325749 | A1 | 10/2020 | Fripp et al. |
| 2020/0370391 | A1 | 11/2020 | Fripp et al. |
| 2021/0017441 | A1 | 1/2021 | Fripp et al. |
| 2021/0032980 | A1 | 2/2021 | Fripp et al. |
| 2021/0040810 | A1 | 2/2021 | Evers |
| 2021/0079756 | A1 | 3/2021 | Ornelaz et al. |
| 2021/0115750 | A1 | 4/2021 | Fripp et al. |
| 2021/0140255 | A1 | 5/2021 | Greci et al. |
| 2021/0189817 | A1 | 6/2021 | Fripp et al. |
| 2021/0230982 | A1 | 7/2021 | Bogardus et al. |
| 2021/0332659 | A1 | 10/2021 | Fripp et al. |
| 2021/0353037 | A1 | 11/2021 | Cote |
| 2022/0074221 | A1 | 3/2022 | Laimbeer et al. |
| 2022/0134410 | A1* | 5/2022 | Xu ..... C23C 16/0272 72/476 |
| 2023/0374890 | A1 | 11/2023 | Zhong et al. |
| 2024/0191605 | A1* | 6/2024 | Newton ..... E21B 43/105 |

FOREIGN PATENT DOCUMENTS

| | | | |
|---|---|---|---|
| CN | 1708631 | A | 12/2005 |
| CN | 102027189 | B | 4/2011 |
| CN | 104583530 | B | 4/2015 |
| CN | 105121777 | B | 12/2015 |
| CN | 105422146 | B | 3/2016 |
| CN | 106522923 | A | 3/2017 |
| CN | 107148444 | B | 9/2017 |
| CN | 107250321 | A | 10/2017 |
| CN | 107532466 | A | 1/2018 |
| DE | 323840 | C | 8/1920 |
| DE | 323842 | C | 8/1920 |
| EP | 1067320 | A2 | 1/2001 |
| EP | 2399000 | B1 | 12/2011 |
| EP | 2217790 | B1 | 10/2016 |
| EP | 2753791 | B1 | 6/2017 |
| FR | 3073549 | B1 | 5/2019 |
| GB | 2381278 | A | 4/2003 |
| GB | 2416796 | B | 2/2006 |
| GB | 2469723 | B | 10/2010 |
| GB | 2514195 | B | 6/2019 |
| GB | 2583232 | B | 10/2020 |
| GB | 2557397 | B | 8/2021 |
| GB | 2600258 | B | 4/2022 |
| MX | 2011008597 | A | 9/2011 |
| RU | 2424419 | C1 | 7/2011 |
| RU | 2588501 | C2 | 6/2016 |
| RU | 182236 | U1 | 8/2018 |
| WO | 2000026501 | A1 | 5/2000 |
| WO | 03004819 | A2 | 1/2003 |
| WO | 2008079486 | A1 | 7/2008 |
| WO | 2010096417 | A2 | 8/2010 |
| WO | 2012090056 | A2 | 7/2012 |
| WO | 2013033208 | A1 | 3/2013 |
| WO | 2014098885 | A1 | 6/2014 |
| WO | 2014110382 | A1 | 7/2014 |
| WO | 2014210283 | A1 | 12/2014 |
| WO | 2016081287 | A1 | 5/2016 |
| WO | 2016171666 | A1 | 10/2016 |
| WO | 2018005740 | A1 | 1/2018 |
| WO | 2018057361 | A1 | 3/2018 |
| WO | 2018085102 | A1 | 5/2018 |
| WO | 2018102196 | A1 | 6/2018 |
| WO | 2018147833 | A1 | 8/2018 |
| WO | 2019094044 | A1 | 5/2019 |
| WO | 2019147285 | A1 | 8/2019 |
| WO | 2019164492 | A1 | 8/2019 |
| WO | 2019164499 | A1 | 8/2019 |
| WO | 2020005252 | A1 | 1/2020 |
| WO | 2020018110 | A1 | 1/2020 |
| WO | 2020068037 | A1 | 4/2020 |
| WO | 2021011013 | A1 | 1/2021 |
| WO | 2021021203 | A1 | 2/2021 |
| WO | 2021034325 | A1 | 2/2021 |
| WO | 2021076141 | A1 | 4/2021 |
| WO | 2021173161 | A1 | 9/2021 |

OTHER PUBLICATIONS

Ellison, et al. "Activated carbon supported Ni, Fe, and bimetallic NiFe catalysts for COx-free H2 production by microwave methane pyrolysis", International Journal of Hydrogen Energy, 55 (2024), 1062-1070.

Ellison, et al. "Dielectric characterization of bentonite clay at various moisture contents and with mixtures of biomass in the microwave spectrum", Journal of Microwave Power and Electromagnetic Energy, 2018, vol. 52, No. 1, 3-15.

Examination Report in GB Application No. GB2205332.6 dated Sep. 7, 2023.

Search Report in NL AppIn No. 2032583 dated Aug. 31, 2023.

Office Action in AR Application No. 20200101954, mailed Oct. 4, 2023.

Office Action in GB Application No. 2213658.4 dated Oct. 5, 2023.

Office Action and Search Report in CN Application No. 2019801021824 dated Sep. 12, 2023.

(56) References Cited

OTHER PUBLICATIONS

Office Action in DE Application No. 112019007811.9 dated Nov. 15, 2023.
International Search Report and Written Opinion mailed Aug. 2, 2018; International PCT Application No. PCT/US2017/061307.
International Search Report and Written Opinion mailed Nov. 19, 2018; International PCT ApplicationNo. PCT/US2018/019337.
International Search Report and Written Opinion date mailed Nov. 11, 2019; International Application No. PCT/US2019/017538.
International Search Report and Written Opinion date mailed Nov. 22, 2019; International PCT Application No. PCT/US2019/019210.
International Search Report and Written Opinion date mailed Apr. 10, 2020; International Application No. PCT/US2019/042074.
International Search Report and Written Opinion date mailed Apr. 28, 2020; International Application No. PCT/US2019/044542.
International Search Report and Written Opinion date mailed May 20, 2020; International Application No. PCT/US2019/047529.
International Search Report and Written Opinion date mailed Jul. 8, 2020; International Application No. PCT/US2019/056814.
International Search Report and Written Opinion date mailed Jul. 23, 2020; International Application No. PCT/US2019/058904.
International Search Report and Written Opinion date mailed Aug. 11, 2020; International Application No. PCT/US2019/062225.
International Search Report and Written Opinion date mailed Sep. 15, 2020; International Application No. PCT/US2019/068493.
International Search Report and Written Opinion date mailed Sep. 17, 2020; International Application No. PCT/US2019/068497.
International Search Report and Written Opinion date mailed Aug. 30, 2021; International Application No. PCT/US2020/065539.
International Search Report and Written Opinion date mailed Sep. 8, 2021; International Application No. PCT/US2020/066193.
International Search Report and Written Opinion date mailed Jan. 10, 2022; International Application No. PCT/US2021/027245.
International Search Report and Written Opinion date mailed Feb. 10, 2022; International Application No. PCT/US2021/032983.
International Search Report and Written Opinion date mailed May 19, 2022; International Application No. PCT/US2021/048628.
International Preliminary Report on Patentability in PCT/US2019/068493, date mailed Jun. 30, 2022.
International Preliminary Report on Patentability in PCT/US2019/068497, date mailed Jun. 30, 2022.
International Preliminary Report on Patentability in PCT/US2019/019210, date mailed Aug. 24, 2021.
International Preliminary Report on Patentability in PCT/US2019/058904, date mailed May 3, 22.
International Preliminary Report on Patentability in PCT/US2019/056814, date mailed Apr. 19, 22.
Search Report in FR Application No. 1859379 mailed Oct. 15, 2019.
GC Examination Report in GC Appln No. 2019-38908 dated Nov. 4, 2020.
Netherlands Search Report in Appln No. 2025954 dated Mar. 2, 2021.
Denmark Examination Report and Search Report date mailed Mar. 16, 2021; Denmark Application No. PA202070389.
Office Action in CA Appln No. 3,070,929 dated Jul. 9, 2021.
Examination Report in GCC Appln No. GC 2020-39914, dated Jul. 29, 2021.
Dutch Search Report issued in NL 2026726, dated Aug. 13, 2021.
Search Report and Written Opinion issued in NL 2026329, dated Aug. 13, 2021.
Dutch Search Report in NL Appln No. 2026737, dated Aug. 13, 2021.
Netherlands Search Report in Appln No. 2026573 dated Aug. 20, 2021.
Written Opinion and Search Report in SG Appln No. 11202000316S, dated Aug. 30, 2021.
Examination Report in GCC Appln No. GC 2020-40201, dated Aug. 31, 2021.
Search Report in NL Appln No. 2025837, dated Sep. 23, 2021.
DK Examination Report in Appln No. PA 202070389 dated Oct. 20, 2021.
Office Action in CA Appln No. 3,070,929 dated Nov. 19, 2021.
Russian Office Action in RU Appln No. 2021121198 dated Nov. 25, 2021.
GC Examination Report in GC Appln No. 2020-40475 dated Nov. 25, 2021.
Chinese Search Report date mailed Dec. 17, 2021; CN Appl No. 2018800875885.
Examination Report in GB Appln No. 2010931.0 dated Jan. 18, 2022.
GB Examination Report in Appln No. 2010931.0 dated Apr. 5, 2022.
MY Search Report in MY Appln No. PI2020003430 dated May 26, 2022.
French Search Report issued in FR Appln No. FR2006166 dated May 30, 2022.
Fripp, Novel Expanding Metal Alloy for Non-Elastomeric Sealing and Anchoring, Research Paper, Oct. 3, 2022, 8 pages, Society of Petroleum Engineers, SPE-210273-MS.
Nemisis Annulus Swellable Packer, Weatherford, Swellable Products, 2009-2011.
Tao, Solid Expandable Tubular Patching Technique for High-Temperature and High-Pressure Casing Damaged Wells, Research Paper, Jun. 2015, pp. 408-413, Petroleum Exploration and Development, vol. 42, Issue 3.
International Search Report and Written Opinion date mailed Feb. 10, 2021; International Application No. PCT/US2020/034887.
First Examination Report in SA Application No. 522441072 dated May 29, 2023.
Written Opinion and Search Report in SG Appln No. 11202112174W, dated Jul. 24, 2023.
Examination Report mailed Jun. 27, 2024 in Canadian Patent Application No. 3,139,190.
International Search Report and Written Opinion mailed Sep. 12, 2024 in PCT/US2023/086272.
Search Report mailed Feb. 16, 2024 in French Patent Application No. 2202120.
Written Opinion mailed Feb. 6, 2025 in Singaporean Patent Application No. 11202112174W.
International Search Report and Written Opinion mailed Sep. 12, 2004 in PCT/US2023/086272.

* cited by examiner

MECHANICAL SUPPORT FOR EXPANDABLE LINER HANGER

TECHNICAL FIELD

The present disclosure relates generally to wellbore operations, and more particularly, to the use of an expansion cone that expands the liner hanger and provides a mechanical support for the expanded liner hanger.

BACKGROUND

In some wellbore operations, a liner may be suspended from a casing string or set cement layer with a liner hanger. The liner hanger anchors to the interior of the casing string or set cement layer and suspends the liner below the casing string or set cement layer. The suspended liner and the liner hanger do not extend to the surface as the casing string or set cement layer may. A liner hanger may be expanded to form a seal with the casing string or set cement layer to prevent fluid flow from outside of the suspended liner. The fluid flow is instead directed through the suspended liner.

Once expanded, the liner hanger may form an annular seal with the casing string or set cement layer. The seal formed by the liner hanger may be subject to high pressure from the annular fluids as well as compressive load from the surrounding casing string or set cement layer. Expanding a liner hanger is an important part of a wellbore operation. The present invention provides improved apparatus and methods for the expansion and mechanical support of a liner hanger.

BRIEF DESCRIPTION OF THE DRAWINGS

Illustrative examples of the present disclosure are described in detail below with reference to the attached drawing figures, which are incorporated by reference herein, and wherein.

Figure 1:
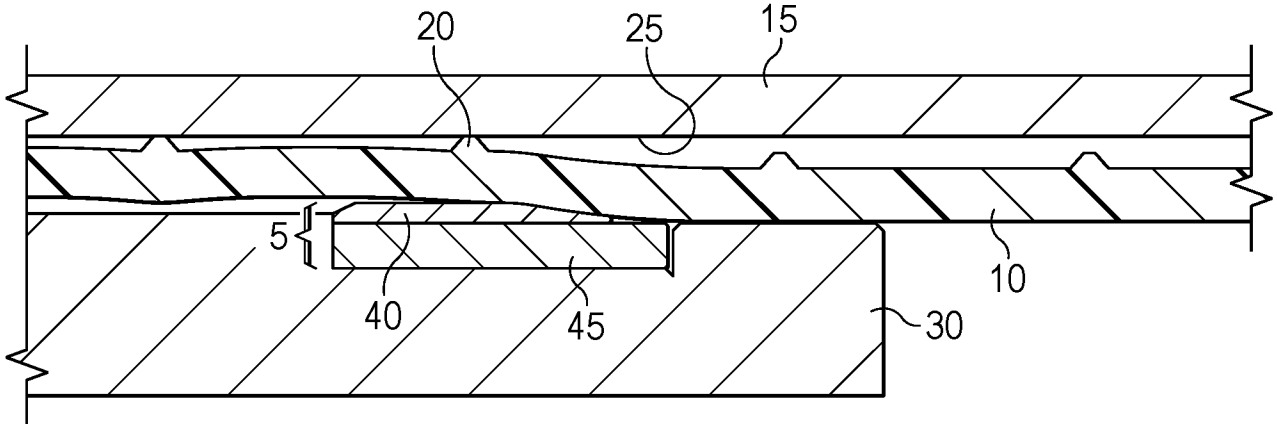
FIG. 1 is a schematic illustrating an example expansion cone for use with a liner hanger in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the use of an expansion cone that expands the liner hanger and provides a mechanical support for the expanded liner hanger.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The terms upstream and downstream may be used to refer to the location of various components relative to one another in regards to the flow of a sample through said components. For example, a first component described as upstream from a second component will encounter a sample before the downstream second component encounters the sample. Similarly, a first component described as being downstream from a second component will encounter the sample after the upstream second component encounters the sample.

The present disclosure relates generally to wellbore operations, and more particularly, to the use of an expansion cone that expands the liner hanger and provides a mechanical support for the expanded liner hanger. Advantageously, the expansion cone may be used to expand a liner hanger to form a seal between the liner hanger and a surrounding casing string or set cement layer. The seal may be formed by a protrusion on the exterior of the liner hanger (e.g., a rib, spike, sealing element, etc.) that contacts, deforms, and grips the surrounding casing string or set cement layer. As a further advantage, the expansion cone comprises a detachable support which detaches from the remainder of the expansion cone and remains in place to provide mechanical support for the expanded liner hanger. The detachable support is configured to always detach from the remaining portion of the expansion cone. As an additional advantage, the set detached support may reinforce the seal provided by the liner hanger. The reinforcement may mitigate higher pressure on the seal and/or increased compressive load on the liner hanger from the surrounding casing string or set cement layer. Additionally, the detachable support is configured to always detach and to then remain as a permanent reinforcement of the liner hanger. One additional advantage is that the reduced diameter of the remaining part of the expansion cone may make removal of the remaining portion of the expansion cone and mandrel easier. As a further advantage, the installation process is a one-trip system and the detachable support is installed after the expansion of the liner hanger. Another advantage is that the detachable support is not expanded during the expansion operation and will not be subject to the Bauschinger effect. The expansion cone may also be used with existing tool designs and may not require modification of existing equipment. The detachable support may be used to reinforce the contact pressure of a protrusion such as a spike, rib, sealing element, etc. Moreover, multiple detachable supports may be used to reinforce the contact pressure of multiple protrusions or a single detachable support may span and reinforce multiple protrusions.

The expansion cones disclosed herein may be used with any type of expandable liner hanger. The expansion cones may be used in a variety of wellbores including, but not limited to, horizontal wellbores, vertical wellbores, deviated wellbores, and the like.

FIG. 1 is a cross-section illustrating an example expansion cone 5 for use in examples of the present invention. An expansion cone, generally 5, has been introduced in a wellbore to expand the liner hanger 10 such that the expanded liner hanger 10 will contact the adjacent casing 15. The expansion cone 5 applies a radial force to the liner hanger 10 to expand the body of the liner hanger 10 radially outward. This radial expansion of the liner hanger 10 forces a protrusion 20 on the exterior of the line hanger 10 to contact the adjacent casing 15 where it may then deform, grip, and apply pressure to the contact surface 25 of the casing 15 forming a seal between the liner hanger 10 and the casing 15. Examples of the protrusion 20 may include, but is not limited to, a rib, spike, sealing element, or a combination of protrusions.

The expansion cone 5 is coupled to a mandrel 30. In the illustrated example, the detachable support 40 resides on the exterior of a releasing component 45. The detachable support 40 detaches from the releasing component 45. The detachable support 40 is configured to always detach from the remainder of the expansion cone 5 and to remain with the liner hanger as a permanent reinforcement. The releasing component 45 is withdrawn from the wellbore along with the mandrel 30. The releasing component 45 may be disposed in a groove, cavity, or other sort of carve-out within the body of the mandrel 30. Alternatively, the releasing component 45 may be disposed on the exterior of the mandrel 30. The releasing component 45 may be wedged over, manufactured around, swaged onto, or otherwise fitted to and disposed within or on the mandrel 30. The detachable support 40 may be coupled to the releasing component 45 using any sufficient method, for example, a shear pin, an adhesive, a collet, a dissolvable material, snap ring, a friction fit, or any combination thereof. The releasing component 45 may itself be a frangible material such as a shearable material, dissolvable material, a fracturable material (e.g., a threaded joint that fractures), a bondable material that is shearable (e.g., shears with glue, epoxy, solder, brazing, etc.), or a combination of materials. The releasing component 45 is an optional component, and in some examples the detachable support 40 is coupled to releasable directly from the mandrel or other service tool. The detachable support 40 is curved and tapered at its contact surface such that the detachable support 40 is able to interface with the interior surface of the liner hanger 10 and provide a transitional surface to force a radial expansion of the liner hanger 10. During expansion, the expansion cone 5 is forced downhole via forced movement of the mandrel 30 and as the expansion cone 5 moves downhole, it applies a force to the liner hanger 10 along its contact surface to radially expand the liner hanger 10 outward toward the adjacent casing 15 or set cement layer.

The detachable support 40 may be used to provide mechanical support to the expanded liner hanger 10. This additional reinforcement may mitigate some of the pressure exerted by the adjacent casing 15 as well as pressure exerted from downhole by a wellbore fluid in the annulus between the liner hanger 10 and the casing 15.

Figure 2:
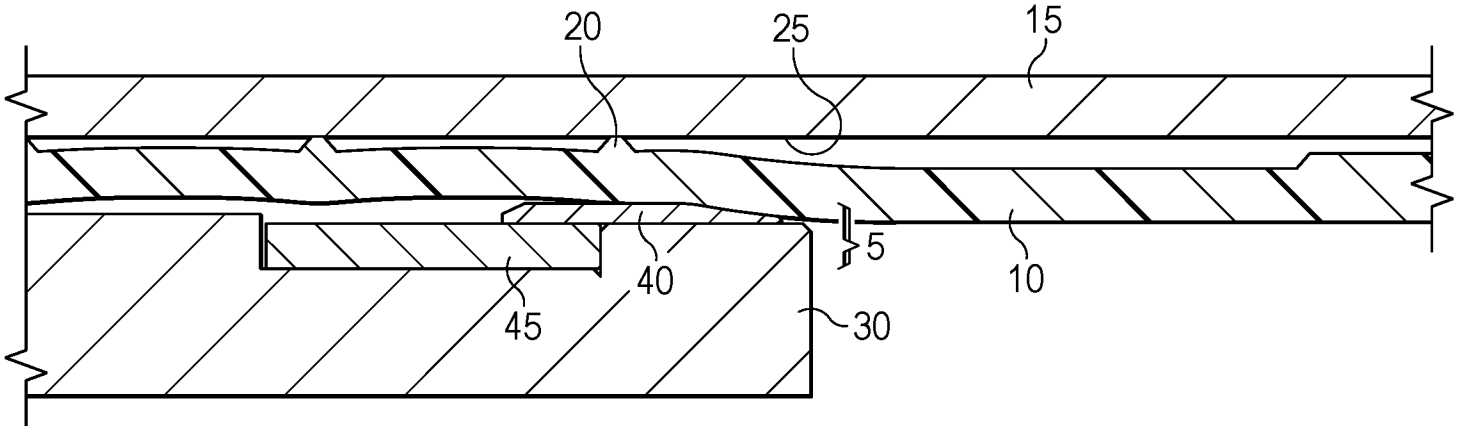
FIG. 2 is a schematic continuing the illustration of the use of the expansion cone of FIG. 1 in accordance with one or more examples described herein.

FIG. 2 is a cross-section illustrating the example expansion cone 5 of FIG. 1 after the expansion cone 5 has expanded the liner hanger 10 and is being retrieved. In the illustrated example, the expansion cone 5 has moved downhole to expand a portion of the liner hanger 10. When the detachable support 40 is in a desired position adjacent to a target protrusion 20, a force is applied to the mandrel 30 to pull the mandrel 30 uphole. The compression load on the detachable support 40 is large enough to grip the detachable support 40 such that the detachable support 40 may be separated from the releasing component 45 and then releasing component 45 may be retrieved alongside the rest of the expansion cone 5. In some examples the inner diameter of the detachable support 40 is the same as the unexpanded portion of the liner hanger 10. In some examples the inner diameter of the detachable support 40 is larger than the unexpanded portion of the liner hanger 10. In other examples, the detachable support 40 may have a different length inner diameter than the unexpanded portion of the liner hanger 10. The detachable support 40 is left in the well as a permanent part of the liner hanger 10. The detachable support 40 may provide reinforcement to the liner hanger 10, moreover, the detachable support 40 may prevent elastic recoil of the liner hanger 10 after expansion of the liner hanger 10. The illustration of FIG. 2 provides just one detachable support 40, but multiple detachable supports 40 may be used in a series such that each of the detachable supports 40 may be positioned underneath a distinct protrusion 20 to provide reinforcement to the individual protrusion 20. These detachable supports 40 may have a uniform inner diameter or may have a stepped inner diameter that may increase or decrease in series. Alternatively, or in addition to, a single detachable support 40 may span multiple protrusions 20 so that an individual detachable support 40 is able to reinforce multiple protrusions 20 simultaneously. In some examples, the contact surface of the detachable support 40 may be reduced in order to lessen the sliding friction on the detachable support 40 when the mandrel 30 is withdrawn.

Figure 3:
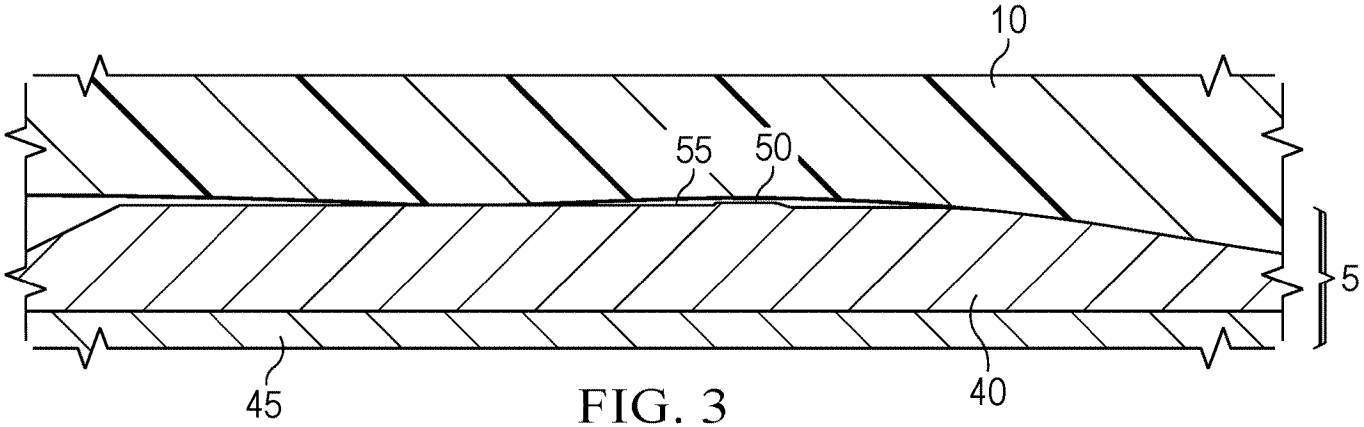
FIG. 3 is a schematic of a protrusion on the expansion cone of FIGS. 1 and 2 in accordance with one or more examples described herein.

FIG. 3 is an enlarged cross-section of the detachable support 40 as illustrated in FIGS. 1 and 2. In the illustration of FIG. 3, an optional protrusion 50 has been added to the contact surface of the detachable support 40 to assist in separation of the detachable support 40. The optional protrusion 50 maybe added to tailor the required load needed to detach the detachable support 40. Moreover, the protrusion 50 may also be added to reduce the force needed for separation of the detachable support 40 when it is believed that the spring back effect of the liner hanger 10 may apply an insufficient gripping force on the detachable support 40 when the mandrel 30 is withdrawn. The protrusion 50 may be any shape and have any height and length as desired. In some examples, multiple protrusions 50 may be used along the contact surface of the detachable support 40.

In some optional examples, the contact surface 55 of the detachable support 40 with the liner hanger 10 may be coated with an expandable metal. The expandable metal may swell to fill any gaps between the liner hanger 10 and the detachable support 40. The expanded metal may improve support and provide a tighter contact between the liner hanger 10 and the detachable support 40.

The expandable metal undergoes a reaction in the presence of a reaction-inducing fluid (e.g., a brine) to form a reaction product (e.g., metal hydroxides). The resulting reaction products occupy more volumetric space relative to the base metal reactant. This difference in volume allows the expandable metal to fill gaps as well as form a seal at the interface of the expanded metal and any adjacent surface. Magnesium may be used to illustrate the volumetric expansion of the reactive metal as it undergoes reaction with the reaction-inducing fluid. A mole of magnesium has a molar mass of 24 g/mol and a density of 1.74 g/cm$^3$, resulting in a volume of 13.8 cm$^3$/mol. Magnesium hydroxide, the reaction product of magnesium and an aqueous reaction-inducing fluid, has a molar mass of 60 g/mol and a density of 2.34 g/cm$^3$, resulting in a volume of 25.6 cm$^3$/mol. The magnesium hydroxide volume of 25.6 cm$^3$/mol is an 85% increase in volume over the 13.8 cm$^3$/mol volume of the mole of magnesium. As another example, a mole of calcium has a molar mass of 40 g/mol and a density of 1.54 g/cm$^3$, resulting in a volume of 26.0 cm$^3$/mol. Calcium hydroxide, the reaction product of calcium and an aqueous reaction-inducing fluid, has a molar mass of 76 g/mol and a density of 2.21 g/cm$^3$, resulting in a volume of 34.4 cm$^3$/mol. The calcium hydroxide volume of 34.4 cm$^3$/mol is a 32% increase in volume over the 26.0 cm$^3$/mol volume of the mole of calcium. As yet another example, a mole of aluminum has a molar mass of 27 g/mol and a density of 2.7 g/cm$^3$, resulting in a volume of 10.0 cm$^3$/mol. Aluminum hydroxide, the reaction product of aluminum and an aqueous reaction-inducing fluid, has a molar mass of 63 g/mol and a density of 2.42 g/cm$^3$ resulting in a volume of 26 cm$^3$/mol. The aluminum hydroxide volume of 26 cm$^3$/mol is a 160% increase in volume over the 10 cm$^3$/mol volume of the mole of aluminum. The expandable metal may comprise any metal or metal alloy that undergoes a reaction to form a reaction product having a greater volume than the base reactive metal or alloy reactant.

Examples of suitable metals for the expandable metal include, but are not limited to, magnesium, calcium, aluminum, tin, zinc, beryllium, barium, manganese, or any combination thereof. Preferred metals include magnesium, calcium, and aluminum.

Examples of suitable metal alloys for the expandable metal include, but are not limited to, alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. In some examples, the metal alloys may comprise alloyed elements that are not metallic. Examples of these non-metallic elements include, but are not limited to, graphite, carbon, silicon, boron nitride, and the like. In some examples, the metal is alloyed to increase reactivity and/or to control the formation of oxides.

In some examples, the metal alloy is also alloyed with a dopant metal that promotes corrosion or inhibits passivation and thus increases hydroxide formation. Examples of dopant metals include, but are not limited to, nickel, iron, copper, carbon, titanium, gallium, mercury, cobalt, iridium, gold, palladium, or any combination thereof.

In some examples, the expandable metal comprises an oxide. As an example, calcium oxide reacts with water in an energetic reaction to produce calcium hydroxide. One mole of calcium oxide occupies 9.5 cm$^3$, whereas one mole of calcium hydroxide occupies 34.4 cm$^3$. This is a 260% volumetric expansion of the mole of calcium oxide relative to the mole of calcium hydroxide. Examples of metal oxides suitable for the reactive metal may include, but are not limited to, oxides of any metals disclosed herein, including magnesium, calcium, aluminum, iron, nickel, copper, chromium, tin, zinc, lead, beryllium, barium, gallium, indium, bismuth, titanium, manganese, cobalt, or any combination thereof.

It is to be understood that the selected expandable metal is chosen such that the formed expanded metal does not dissolve or otherwise degrade in the reaction-inducing fluid. As such, the use of metals or metal alloys for the expandable metal that form relatively insoluble reaction products in the reaction-inducing fluid may be preferred. As an example, the magnesium hydroxide and calcium hydroxide reaction products have very low solubility in water. As an alternative or an addition, the expandable metal may be positioned and configured in a way that constrains the degradation of the expandable metal in the reaction-inducing fluid due to the geometry of the area in which the expandable metal is disposed. This may result in reduced exposure of the expandable metal to the reaction-inducing fluid, but may also reduce degradation of the reaction product of the expandable metal, thereby prolonging the life of the expanded metal. As an example, the volume of the area in which the expandable metal is disposed may be less than the potential expansion volume of the volume of expanded metal disposed in said area. In some examples, this volume of area may be less than as much as 50% of the expansion volume of expanded metal. Alternatively, this volume of area may be less than 90% of the expansion volume of expanded metal. As another alternative, this volume of area may be less than 80% of the expansion volume of expanded metal. As another alternative, this volume of area may be less than 70% of the expansion volume of expanded metal. As another alternative, this volume of area may be less than 60% of the expansion volume of expanded metal. In a specific example, a portion of the expandable metal may be disposed in a recess within the body of the conduit or downhole tool.

The expandable metal may be formed in a solid solution process, a powder metallurgy process, or through any other method as would be apparent to one of ordinary skill in the art. Regardless of the method of manufacture, the expandable metal may be slipped over the body of the conduit or downhole tool. Once in place, the expandable metal may be held in position with end rings, stamped rings, retaining rings, set screws, or any other such method for retaining the expandable metal in position. The expandable metal may be formed and shaped to fit over the detachable support 40 and thus may not require modification of the outer diameter or profile of the detachable support 40. In alternative examples, the expandable metal may be cast onto the detachable support 40. In some alternative examples, the diameter of the expandable metal may be reduced (e.g., by swaging) when disposed on the detachable support 40.

In some optional examples, the expandable metal may include a removable barrier coating. The removable barrier coating may be used to cover the exterior surfaces prevent contact of the expandable metal with the reaction-inducing fluid. The removable barrier coating may be removed when desired. The removable barrier coating may be used to delay and/or prevent premature expansion of the expandable metal. Examples of the removable barrier coating include, but are not limited to, any species of plastic shell, organic shell, paint, dissolvable coatings (e.g., solid magnesium compounds), eutectic materials, or any combination thereof. When desired, the removable barrier coating may be removed from the expandable metal with any sufficient method. For example, the removable barrier coating may be removed through dissolution, a phase change induced by changing temperature, corrosion, hydrolysis, or the removable barrier coating may be time-delayed and degrade after a desired time under specific wellbore conditions. In some examples, the reaction of a portion of the expandable metal may remove support for the removable barrier coating and the removable barrier coating may collapse as the underlying reactive metal undergoes a chemical reaction with the reaction-inducing fluid.

It should be clearly understood that the example system illustrated by FIGS. 1-3 is merely a general application of the principles of this disclosure in practice, and a wide variety of other examples are possible. Therefore, the scope of this disclosure is not limited in any manner to the details of FIGS. 1-3 as described herein.

Figure 4:
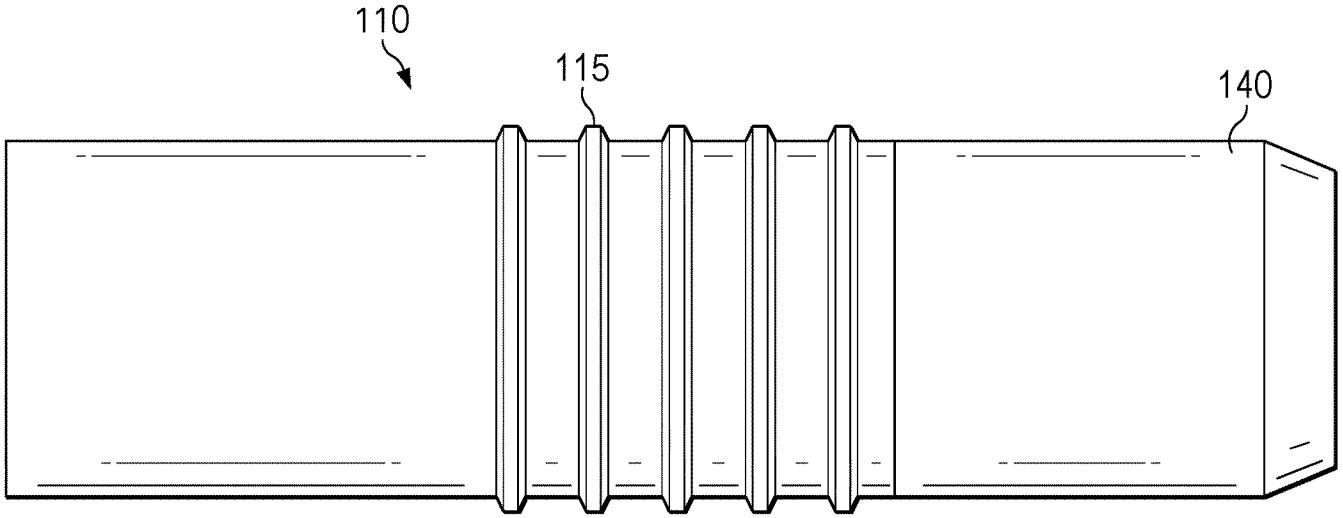
FIG. 4 is a schematic illustrating an example liner hanger in accordance with one or more examples described herein.

FIG. 4 is an illustration of the exterior of a liner hanger 110 having a protrusion 115. Portion 140 of the liner hanger 110 ray remain unexpanded by an expansion cone.

Figure 5A:
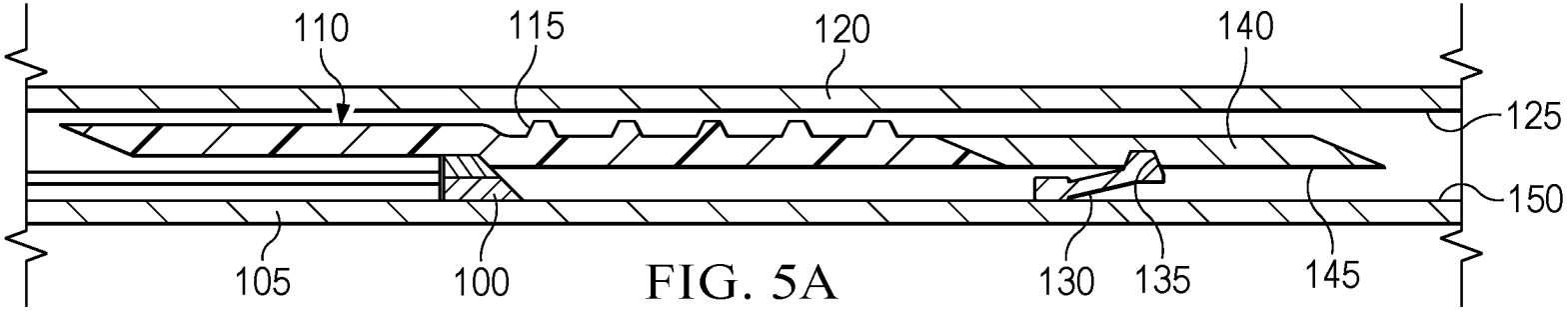
FIG. 5A is a schematic illustrating the use of an example expansion cone with the liner hanger of FIG. 4 in accordance with one or more examples described herein.

FIGS. 5A-5D are illustrations of another example of an expansion cone 100 disposed on an exterior surface of a mandrel 105. In FIG. 5A, the expansion cone 100 is forced downhole by movement of the mandrel 105. The expansion cone 100 contacts the interior surface of the adjacent liner hanger 110 (i.e., liner hanger 110 in FIG. 4). As the expansion cone 100 is pushed downhole, it applies a radial force to the liner hanger 110 to expand the body of the liner hanger 110 radially outward. This radial expansion of the liner hanger 110 forces a protrusion 115 on the exterior of the liner hanger 110 to contact the adjacent casing 120 and then deform, grip, and apply pressure to the contact surface 125 of the casing 120. The liner hanger 110 may then form a seal between itself and the casing 120. The protrusion 115 may include, but is not limited to, a rib, spike, sealing element, or a combination of protrusions. The mandrel 105 further comprises a deployment mechanism 130 on its exterior surface 150 that engages with a corresponding attachment point 135 on the interior surface 145 of the liner hanger 110. The deployment mechanism 130 may be a collet, snap ring, or any such mechanism that may engage with a corresponding attachment point 135 on the interior surface 145 of the liner hanger 110. The attachment point 135 is any profile variance, for example, a slot, groove, cutout, or similar variance on the interior surface 145 of the liner hanger 110. In the example of FIG. 5, the attachment point 135 is present on an unexpanded portion 140 of the liner hanger 110.

Figure 5B:
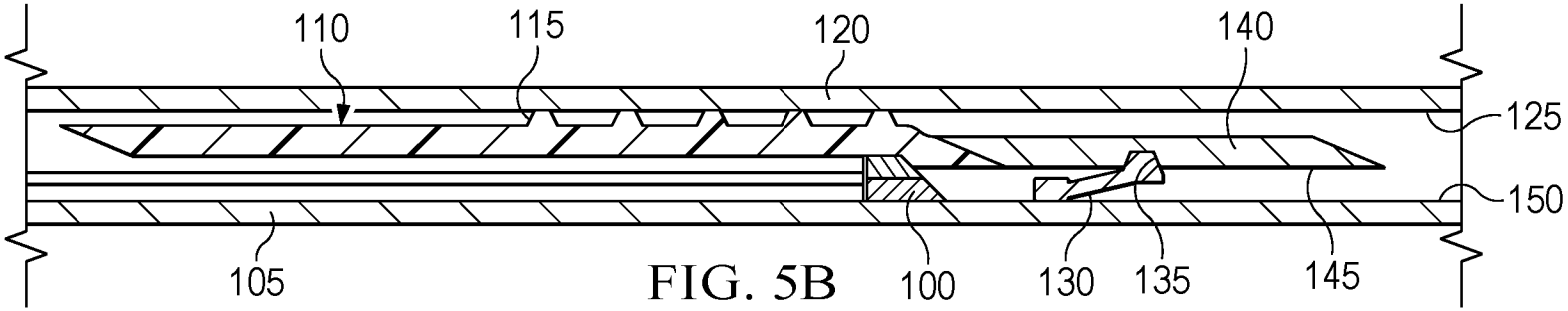
FIG. 5B is a schematic illustrating the continued use of an example expansion cone with the liner hanger of FIG. 4 in accordance with one or more examples described herein.

In FIG. 5B, the mandrel 105 has been moved downhole and consequently, the coupled expansion cone 100 on its exterior surface 150 has forced a radial expansion to a portion of the adjacent liner hanger 110. The deployment mechanism 130 is locked into the attachment point 135 on the liner hanger 110.

Figure 5C:
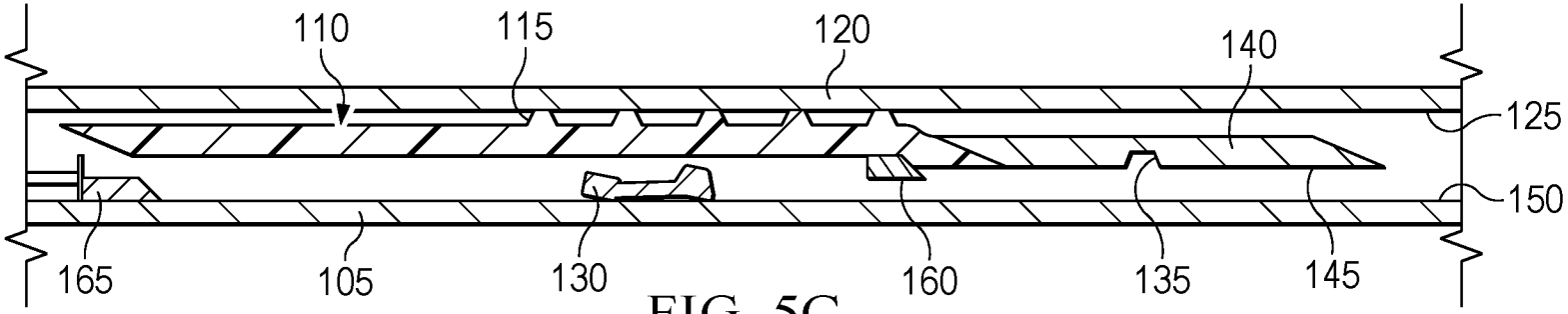
FIG. 5C is a schematic illustrating the continued use of an example expansion cone with the liner hanger of FIG. 4 in accordance with one or more examples described herein.

In FIG. 5C, the deployment mechanism 130 has detached from the attachment point 135 of the liner hanger 110 and the mandrel 105 is in process of being retrieved. As the mandrel 105 is retrieved, the detachable support 160 of the expansion cone (i.e., expansion cone 100 in operation A) has separated from the releasing component 165. The detachable support 160 may be coupled to the releasing component 165 by a shear pin, an adhesive, a collet, a dissolvable material, a snap ring, a friction fit, or any combination thereof.

Figure 5D:
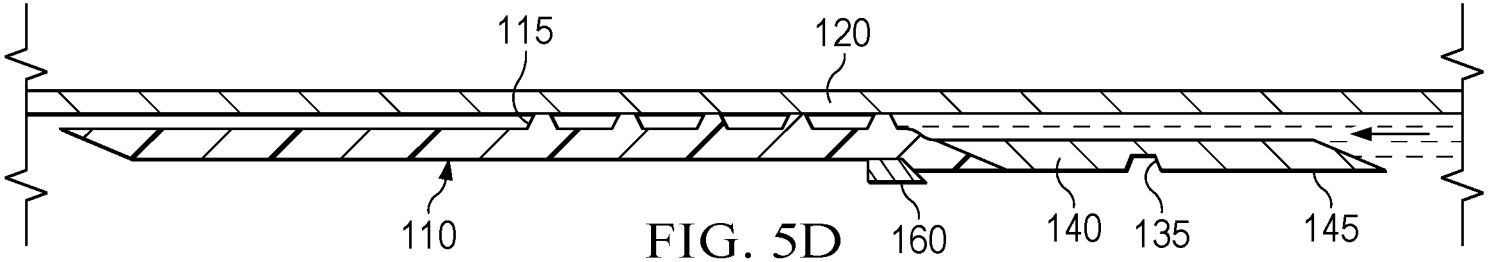
FIG. 5D is a schematic illustrating the continued use of an example expansion cone with the liner hanger of FIG. 4 in accordance with one or more examples described herein.

In FIG. 5D, the detachable support 160 has been set and is now in place adjacent to a protrusion 115 on the exterior of the liner hanger 110. The set detachable support 160 will now remain in place as a permanent reinforcing support for the liner hanger 110.

It should be clearly understood that the example system illustrated by FIGS. 4-5D are merely general applications of the principles of this disclosure in practice, and a wide variety of other examples are possible. Therefore, the scope of this disclosure is not limited in any manner to the details of FIGS. 4-5D as described herein.

Figure 6:
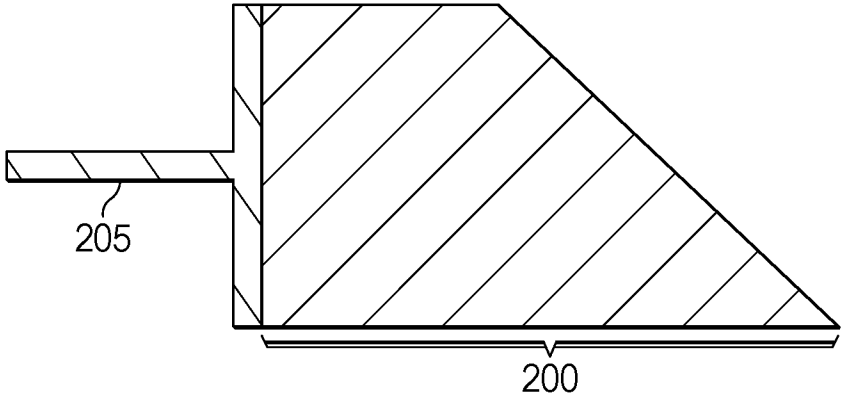
FIG. 6 is a schematic illustrating an example expansion cone for use with a liner hanger in accordance with one or more examples described herein.

FIG. 6 is an illustration of an expansion cone 200 coupled to a service tool 205. In the illustrated example, the entirety of the expansion cone 200 serves as the detachable support. The expansion cone 200 is coupled to a service tool 205 which may be used to fix the expansion cone 200 in place as it travels downhole alongside a mandrel. The expansion cone 200 may be coupled to the service tool 205 using any sufficient connection mechanism including, but not limited to, a shear pin, an adhesive, a collet, a dissolvable material, a snap ring, a friction fit, or any combination thereof. When detached from the service tool 205, the expansion cone 200 remains in place to provide reinforcement to an adjacent liner hanger. The service tool 205 may be retrieved alongside the mandrel once the expansion cone 200 has detached.

It should be clearly understood that the example system illustrated by FIG. 6 is merely a general application of the principles of this disclosure in practice, and a wide variety of other examples are possible. Therefore, the scope of this disclosure is not limited in any manner to the details of FIG. 6 as described herein.

Figure 7A:
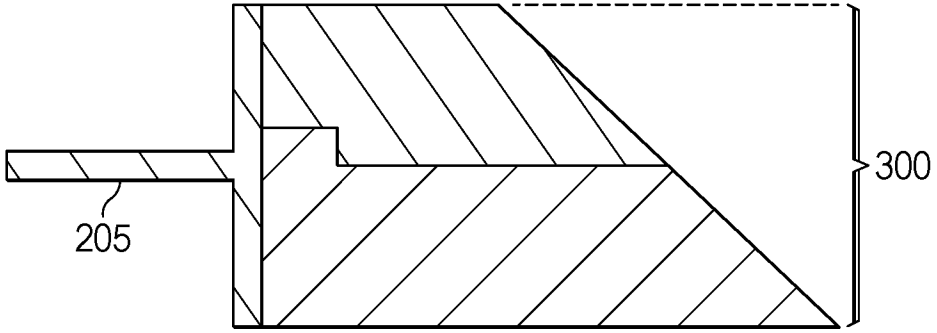
FIG. 7A is a schematic illustrating another example expansion cone for use with a liner hanger in accordance with one or more examples described herein.
Figure 7B:
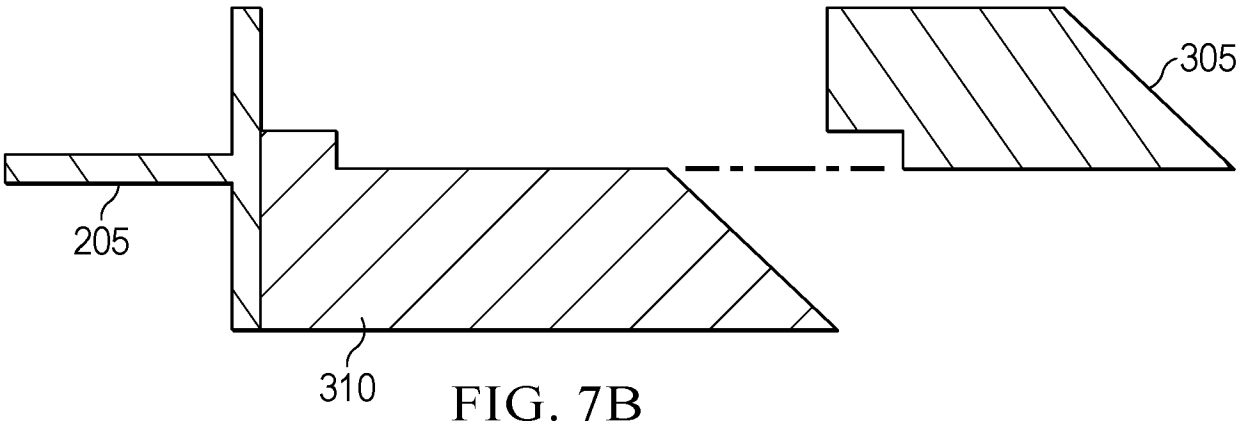
FIG. 7B is a schematic illustrating additional detail of the example expansion cone of FIG. 7A in accordance with one or more examples described herein.

FIGS. 7A-7B are illustrations of another expansion cone 300 coupled to a service tool 205. In the illustrated example, the expansion cone 300 comprises a detachable support 305 and a releasing component 310. The releasing component 310 is coupled to the service tool 205 and the detachable support 305 is coupled to the releasing component 310. The service tool 205 may be used to fix the detachable support 305 in place as it travels downhole alongside a mandrel. The releasing component 310 may be coupled to the detachable support 305 using any sufficient connection mechanism including, but no limited to, a shear pin, an adhesive, a collet, a dissolvable material, a snap ring, a friction fit, or any combination thereof. When detached from the releasing component 310, the detachable support 305 remains in place to provide reinforcement to an adjacent liner hanger. The service tool 205 may be retrieved alongside the mandrel once the detachable support 305 has detached. The releasing component 310 is retrieved alongside the service tool 205. In the illustrated example, the interface between the detachable support 305 and the releasing component 310 is a stepped interface. In this particular example, a friction fit along the stepped interface may be used to couple the detachable support 305 and the releasing component 310. Although only one step on the interface is illustrated, it is to be understood that multiple steps may be present in some alternative examples.

It should be clearly understood that the example system illustrated by FIGS. 7A-7B are merely a general application of the principles of this disclosure in practice, and a wide variety of other examples are possible. Therefore, the scope of this disclosure is not limited in any manner to the details of FIG. 7A-7B as described herein.

Figure 8A:
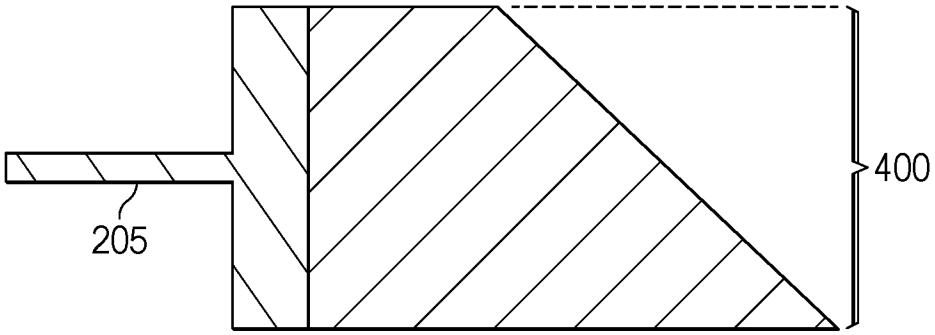
FIG. 8A is a schematic illustrating an additional example expansion cone for use with a liner hanger in accordance with one or more examples described herein.
Figure 8B:
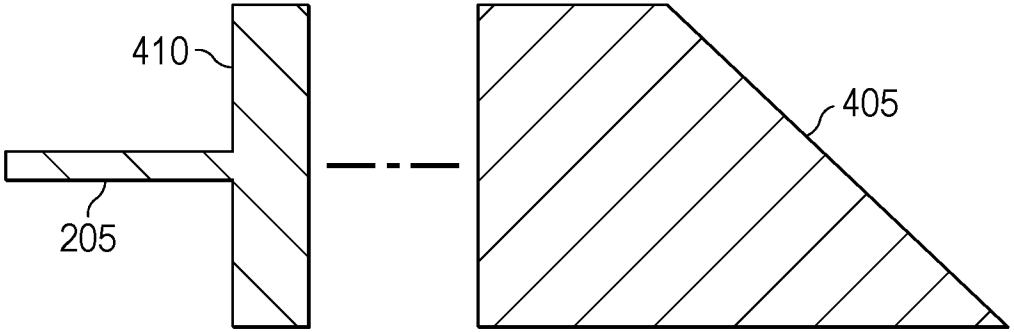
FIG. 8B is a schematic illustrating additional detail of the example expansion cone of FIG. 8A in accordance with one or more examples described herein.

FIGS. 8A-8B are illustrations of another expansion cone 400 coupled to a service tool 205. In the illustrated example, the expansion cone 400 comprises a detachable support 405 and a releasing component 410. The releasing component 410 is coupled to the service tool 205 and the detachable support 405 is coupled to the releasing component 410. The service tool 205 may be used to fix the detachable support 405 in place as it travels downhole alongside a mandrel. The releasing component 410 may be coupled to the detachable support 405 using any sufficient connection mechanism including, but no limited to, a shear pin, an adhesive, a collet, a dissolvable material, a snap ring, a friction fit, or any combination thereof. When detached from the releasing component 410, the detachable support 405 remains in place to provide reinforcement to an adjacent liner hanger. The service tool 205 may be retrieved alongside the mandrel once the detachable support 405 has detached. The releasing component 410 is retrieved alongside the service tool 205. In the illustrated example, the interface between the detachable support 405 and the releasing component 410 is a vertical interface that runs vertically along the height of the expansion cone 400.

It should be clearly understood that the example system illustrated by FIGS. 8A-8B merely a general application of the principles of this disclosure in practice, and a wide variety of other examples are possible. Therefore, the scope of this disclosure is not limited in any manner to the details of FIGS. 8A-8B as described herein.

Figure 9A:
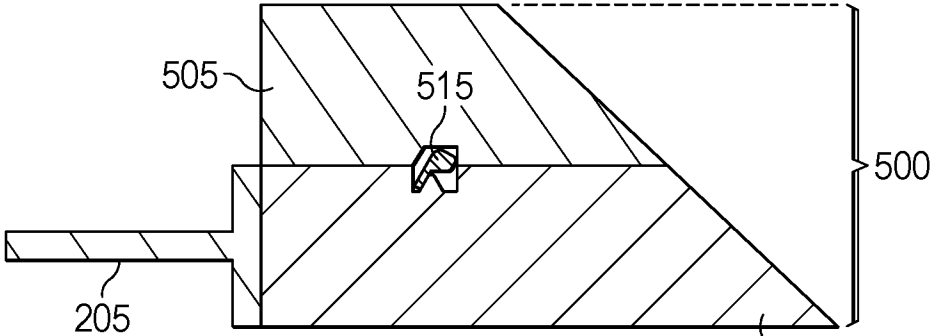
FIG. 9A is a schematic illustrating another example expansion cone for use with a liner hanger in accordance with one or more examples described herein.
Figure 9B:
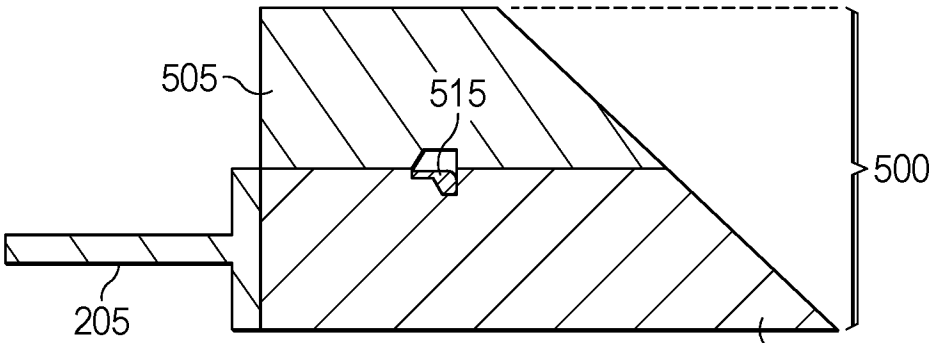
FIG. 9B is a schematic illustrating additional detail of the example expansion cone of FIG. 9A in accordance with one or more examples described herein.
Figure 9C:
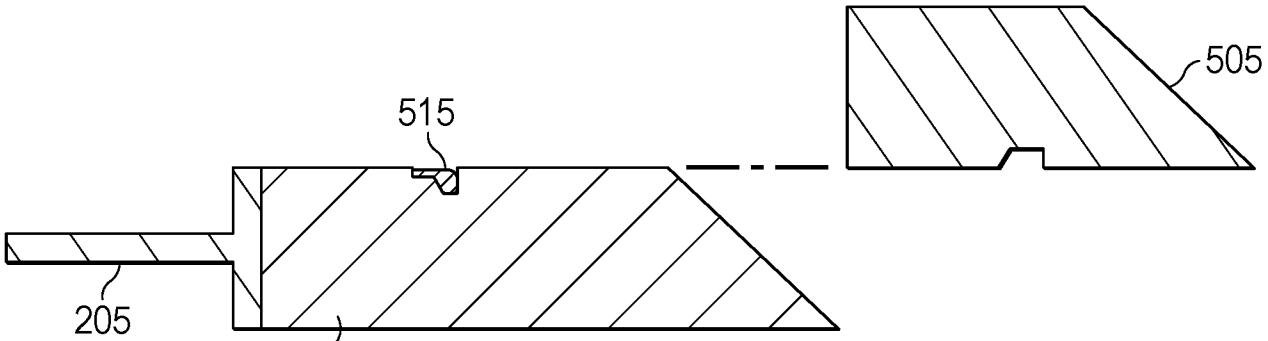
FIG. 9C is a schematic illustrating additional detail of the example expansion cone of FIG. 9A in accordance with one or more examples described herein.

FIGS. 9A-9C are illustrations of another expansion cone 500 coupled to a service tool 205. In the illustrated example, the expansion cone 500 comprises a detachable support 505 and a releasing component 510. The releasing component 510 is coupled to the service tool 205 and the detachable support 505 is coupled to the releasing component 510. The service tool 205 may be used to fix the detachable support 505 in place as it travels downhole alongside a mandrel. When detached from the releasing component 510, the detachable support 505 remains in place to provide reinforcement to an adjacent liner hanger. The service tool 205 may be retrieved alongside the mandrel once the detachable support 505 has detached. The releasing component 510 is retrieved alongside the service tool 205. In the illustrated example, the detachable support 505 is coupled to the releasing component 510 with a snap ring 515. In FIG. 9A, the snap ring 515 is configured to not release the detachable support 505 as the expansion cone 500 is run-in-hole to expand a liner hanger. In FIG. 9B, the applied force has been reversed to pull the service tool 205 in the uphole direction (i.e., to the left in the illustration) and this reversal of force has resulted in shifting the orientation of the snap ring 515. In FIG. 9C, now that the snap ring 515 has shifted configurations, the detachable support 505 is able to detach from the releasing component 510 as the releasing component 510 is pulled uphole alongside the service tool 205 and the mandrel.

It should be clearly understood that the example system illustrated by FIGS. 9A-9C is merely a general application of the principles of this disclosure in practice, and a wide variety of other examples are possible. Therefore, the scope of this disclosure is not limited in any manner to the details of FIGS. 9A-9C as described herein.

The systems disclosed herein may directly or indirectly affect one or more components or pieces of equipment associated with or which may come into contact with the expansion cones disclosed herein such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Provided is an expansion cone for an expandable liner hanger in accordance with the disclosure and the illustrated FIGs. An example expansion cone comprises a detachable support coupled to a mandrel. The detachable support is configured to contact an interior surface of the expandable liner hanger during expansion of the liner hanger. The detachable support is further configured to detach after the liner hanger is expanded thereby producing a detached support. The detached support remains in contact with the interior surface of the expandable liner hanger after expansion of the expandable liner hanger and removal of the mandrel.

Additionally or alternatively, the expansion cone may include one or more of the following features individually or in combination. The liner hanger may comprise a protrusion and the detached support is positioned adjacent to the protrusion. The liner hanger may comprise two protrusions and the detached support is positioned adjacent to the two protrusions. The expansion cone may comprise multiple detachable supports. The detachable support may comprise a contact surface in contact with the interior surface of the expandable liner hanger after expansion of the expandable liner hanger and removal of the mandrel, and the detachable support may further comprise a protrusion on the contact surface. The detachable support may comprise an expandable metal on a contact surface that remains in contact with the interior surface of the expandable liner hanger after expansion of the expandable liner hanger and removal of the mandrel. The expansion cone may further comprise a releasing component that is coupled to the detachable support. The detachable support may be configured to detach from the releasing component. The detachable support may be detachably coupled to the releasing component with at least one of a shear pin, an adhesive, a collet, a dissolvable material, a snap ring, a friction fit, or any combination thereof. The releasing component may be disposed in a groove within the mandrel. The releasing component may be disposed on the exterior of the mandrel. The detachable support and the releasing component may contact each other with a stepped interface.

Provided are methods for expanding a liner hanger in accordance with the disclosure and the illustrated FIGs. An example method comprises providing an expansion cone comprising: a detachable support coupled to a mandrel. The method further comprises applying pressure to an interior surface of the liner hanger with the expansion cone to expand the liner hanger; and detaching the detachable support from the expansion cone after the liner hanger is expanded to produce a detached support that remains in contact with the interior surface of the expandable liner hanger after expansion of the expandable liner hanger.

Additionally or alternatively, the method may include one or more of the following features individually or in combination. The method may further comprise removing the mandrel after the detachable support has detached. The liner hanger may comprise a protrusion and the detached support is positioned adjacent to the protrusion. The liner hanger may comprise two protrusions and the detached support is positioned adjacent to the two protrusions. The expansion cone may comprise multiple detachable supports. The detachable support may comprise a contact surface in contact with the interior surface of the expandable liner hanger after expansion of the expandable liner hanger and removal of the mandrel, and the detachable support may further comprise a protrusion on the contact surface. The detachable support may comprise an expandable metal on a contact surface that remains in contact with the interior surface of the expandable liner hanger after expansion of the expandable liner hanger and removal of the mandrel. The expansion cone may further comprise a releasing component that is coupled to the detachable support. The detachable support may be configured to detach from the releasing component. The detachable support may be detachably coupled to the releasing component with at least one of a shear pin, an adhesive, a collet, a dissolvable material, a snap ring, a friction fit, or any combination thereof. The releasing component may be disposed in a groove within the mandrel. The releasing component may be disposed on the exterior of the mandrel. The detachable support and the releasing component may contact each other with a stepped interface.

Provided are systems for using an expansion cone to expand a liner hanger in accordance with the disclosure and the illustrated FIGs. An example system comprises a liner hanger having an interior surface and an expansion cone. The expansion cone comprises a detachable support coupled to a mandrel. The detachable support is configured to contact the interior surface of the expandable liner hanger during expansion of the liner hanger. The detachable support is further configured to detach after the liner hanger is expanded thereby producing a detached support. The detached support remains in contact with the interior surface of the expandable liner hanger after expansion of the expandable liner hanger and removal of the mandrel.

Additionally or alternatively, the system may include one or more of the following features individually or in combination. The liner hanger may comprise a protrusion and the detached support is positioned adjacent to the protrusion. The liner hanger may comprise two protrusions and the detached support is positioned adjacent to the two protrusions. The expansion cone may comprise multiple detachable supports. The detachable support may comprise a contact surface in contact with the interior surface of the expandable liner hanger after expansion of the expandable liner hanger and removal of the mandrel, and the detachable support may further comprise a protrusion on the contact surface. The detachable support may comprise an expandable metal on a contact surface that remains in contact with the interior surface of the expandable liner hanger after expansion of the expandable liner hanger and removal of the mandrel. The expansion cone may further comprise a releasing component that is coupled to the detachable support. The detachable support may be configured to detach from the releasing component. The detachable support may be detachably coupled to the releasing component with at least one of a shear pin, an adhesive, a collet, a dissolvable material, a snap ring, a friction fit, or any combination thereof. The releasing component may be disposed in a groove within the mandrel. The releasing component may be disposed on the exterior of the mandrel. The detachable support and the releasing component may contact each other with a stepped interface.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. An expansion cone for an expandable liner hanger, the expansion cone comprising:

a detachable support coupled to a mandrel; wherein the detachable support is configured to contact an interior surface of the expandable liner hanger during expansion of the liner hanger; wherein the detachable support remains coupled to the mandrel during expansion of the liner hanger; wherein the detachable support is further configured to detach after the liner hanger is expanded thereby producing a detached support; wherein the detached support remains in contact with the interior surface of the expandable liner hanger after expansion of the expandable liner hanger and removal of the mandrel; wherein the detached support is configured to detach from the mandrel when the mandrel is pulled uphole; wherein the liner hanger comprises a protrusion and the detached support is positioned adjacent to the protrusion to reinforce a contact pressure of the protrusion on an adjacent surface; wherein the detachable support comprises a contact surface in contact with the interior surface of the expandable liner hanger after expansion of the expandable liner hanger and removal of the mandrel; wherein the detachable support further comprises a protrusion on the contact surface.

2. The expansion cone of claim 1, wherein the liner hanger comprises two protrusions and the detached support is positioned adjacent to the two protrusions.

3. The expansion cone of claim 1, wherein the expansion cone comprises multiple detachable supports.

4. The expansion cone of claim 1, wherein the detachable support comprises an expandable metal on a contact surface that remains in contact with the interior surface of the expandable liner hanger after expansion of the expandable liner hanger and removal of the mandrel.

5. The expansion cone of claim 1, wherein the expansion cone further comprises a releasing component that is coupled to the detachable support.

6. The expansion cone of claim 5, wherein the detachable support is configured to detach from the releasing component.

7. The expansion cone of claim 6, wherein the detachable support is detachably coupled to the releasing component with at least one of a shear pin, an adhesive, a collet, a dissolvable material, a snap ring, a friction fit, or any combination thereof.

8. The expansion cone of claim 7, wherein the releasing component is disposed in a groove within the mandrel.

9. The expansion cone of claim 7, wherein the releasing component is disposed on the exterior of the mandrel.

10. The expansion cone of claim 7, wherein the detachable support and the releasing component contact each other with a stepped interface.

11. A method for expanding a liner hanger, the method comprises:

providing an expansion cone comprising:

a detachable support coupled to a mandrel;

applying pressure to an interior surface of the liner hanger with the expansion cone to expand the liner hanger;

detaching the detachable support from the expansion cone by pulling the mandrel uphole after the liner hanger is expanded to produce a detached support that remains in contact with the interior surface of the expandable liner hanger after expansion of the expandable liner hanger; wherein the detachable support remains coupled to the mandrel during expansion of the liner hanger; and wherein the liner hanger comprises a protrusion and the detached support is positioned adjacent to the protrusion to reinforce a contact pressure of the protrusion on an adjacent surface; wherein the detachable support comprises a contact surface in contact with the interior surface of the expandable liner hanger after expansion of the expandable liner hanger and removal of the mandrel; wherein the detachable support further comprises a protrusion on the contact surface.

12. The method of claim 11, further comprising:

removing the mandrel after the detachable support has detached.

13. The method of claim 11, wherein the expansion cone further comprises a releasing component and the detachable support is detachably coupled to the releasing component with at least one of a shear pin, an adhesive, a collet, a dissolvable material, a snap ring, a friction fit, or any combination thereof.

14. The method of claim 11, wherein the expansion cone comprises multiple detachable supports.

15. A system for expanding a liner hanger, the system comprising:

a liner hanger having an interior surface;

an expansion cone comprising:

a detachable support coupled to a mandrel; wherein the detachable support is configured to contact the interior surface of the expandable liner hanger during expansion of the liner hanger; wherein the detachable support remains coupled to the mandrel during expansion of the liner hanger; wherein the detachable support is further configured to detach after the liner hanger is expanded thereby producing a detached support; wherein the detached support remains in contact with the interior surface of the expandable liner hanger after expansion of the expandable liner hanger and removal of the mandrel; wherein the detached support is configured to detach from the mandrel when the mandrel is pulled uphole; wherein the liner hanger comprises a protrusion and the detached support is positioned adjacent to the protrusion to reinforce a contact pressure of the protrusion on an adjacent surface; wherein the detachable support comprises a contact surface in contact with the interior surface of the expandable liner hanger after expansion of the expandable liner hanger and removal of the mandrel; wherein the detachable support further comprises a protrusion on the contact surface.

16. The system of claim 15, wherein the expansion cone comprises multiple detachable supports.

17. The system of claim 15, wherein the liner hanger comprises two protrusions and the detached support is positioned adjacent to the two protrusions.

18. The system of claim 15, wherein the detachable support comprises an expandable metal on a contact surface that remains in contact with the interior surface of the expandable liner hanger after expansion of the expandable liner hanger and removal of the mandrel.

19. The system of claim 15, wherein the expansion cone further comprises a releasing component that is coupled to the detachable support.

20. The system of claim 15, wherein the detachable support is configured to detach from the releasing component.

* * * * *